United States Patent [19]

Amis et al.

[11] Patent Number: 5,063,764

[45] Date of Patent: Nov. 12, 1991

[54] ROLL-UP DOOR LOCK

[75] Inventors: Lynn F. Amis, Valley, Nebr.; Jacob T. Crittenden, San Diego, Calif.; Raymond J. Dyer, Lincoln, Nebr.; John P. Glynn, Lincoln, Nebr.; Richard H. Hall, Bellevue, Nebr.; Dave L. Huebner, Lincoln, Nebr.; Brian W. Olsen, Beaver Crossing, Nebr.; Sam C. O'Connor, Lincoln, Nebr.; Charles E. Robideaux, Bellevue, Nebr.; David E. Seeley; Steven J. Sousek, both of Lincoln, Nebr.; Mark A. Wightman, North Platte, Nebr.; Ronald E. Wintermute, Aurora, Ill.

[73] Assignee: Convoy Security Company, Omaha, Nebr.

[21] Appl. No.: 307,909

[22] Filed: Feb. 9, 1989

[51] Int. Cl.[5] ..... E05B 65/08; E05C 3/04

[52] U.S. Cl. ..... 70/100; 70/285; 70/436; 292/207; 292/241; 292/DIG. 32

[58] Field of Search ..... 70/285, 436, 100; 292/207, 241, DIG. 32, 240

[56] References Cited

U.S. PATENT DOCUMENTS

| | | | |
|---|---|---|---|
| 827,177 | 7/1906 | Pixley | 70/436 |
| 1,465,136 | 8/1923 | Klein | 70/436 |
| 1,699,190 | 1/1929 | Hoffmann | 70/436 |
| 3,040,556 | 6/1962 | Rosenhagen . | |
| 3,751,718 | 8/1973 | Hanchett, Jr. | 317/134 |
| 3,831,065 | 8/1974 | Martin et al. | 317/134 |
| 3,876,913 | 4/1975 | Perry | 317/134 |
| 3,885,408 | 5/1975 | Clark, Jr. | 70/278 |
| 3,893,722 | 7/1975 | Galbreath et al. | 70/211 X |
| 4,094,175 | 6/1978 | Pechner | 70/383 X |
| 4,161,870 | 7/1979 | Barnes | 70/278 |
| 4,324,426 | 4/1982 | Mickelson | 292/281 |
| 4,372,136 | 2/1983 | Mickelson | 70/14 |
| 4,389,862 | 6/1983 | Hastings | 70/2 |
| 4,534,194 | 8/1985 | Aydin | 70/278 |
| 4,627,248 | 12/1986 | Haworth | 292/207 X |
| 4,637,237 | 1/1987 | Witkoski et al. | 70/285 |

FOREIGN PATENT DOCUMENTS

| | | | |
|---|---|---|---|
| 245726 | 3/1926 | Italy | 70/285 |

OTHER PUBLICATIONS

*Official Gazette*, 8/4/87, p. 57.
Eberhard advertising literature.
Security Transport, Inc. advertising brochure.
Encrypta Electronics, Ltd. advertising literature.

*Primary Examiner*—Lloyd A. Gall
*Attorney, Agent, or Firm*—Zarley, McKee, Thomte, Voorhees & Sease

[57] ABSTRACT

A lock is described which is adapted for use in combination with a conventional latching handle assembly mounted on the bottom panel of a roll-up door mounted on a truck or the like. The lock includes a laterally movable dead bolt which, when locked, is in the pivotal path of the latching handle assembly thereby preventing the latching handle assembly from being moved to its unlocked position. A counter is also associated with the lock which visually indicates the number of times that the lock has been actuated.

6 Claims, 2 Drawing Sheets

ROLL-UP DOOR LOCK

BACKGROUND OF THE INVENTION

This invention relates to a door lock and more particularly to a roll-up door lock designed to prevent the unauthorized opening of a roll-up door on a truck body or the like. The door lock of this invention also includes a counter means which is actuated each time the lock is actuated.

Roll-up doors have long been used on truck bodies or the like. Generally speaking, the roll-up doors comprise a plurality of horizontally disposed panels or sections which are hingedly secured to one another and which may be vertically moved to either close or open the opening in which it is mounted. The vast majority of the conventional roll-up doors include some sort of locking handle assembly mounted at the exterior surface of the lower most panel designed to prevent the opening of the door when in its locked position. In some cases, a padlock is used to maintain the locking handle assembly in its locked position. In other cases, flexible seals are utilized to indicate whether the door has been opened. Both of the methods described hereinabove possess some disadvantages.

It is therefore a principal object to provide an improved door lock for a roll-up door.

A further object of the invention is to provide a lock for a roll-up door including a dead bolt which is positioned, when in its locked position, in the movable path of the actuating handle thereby preventing unauthorized opening of the door.

A further object of the invention is to provide a device of the type described including a counter which visually indicates the number of times that the lock has been actuated.

Still another object of the invention is to provide a device of the type described which is substantially tamper-proof.

Still another object of the invention is to provide a device of the type described which may be easily mounted on the lower most panel of the door adjacent the conventional locking handle assembly.

Still another object of the invention is to provide a device of the type described which is economical of manufacture, durable in use and refined in appearance.

These and other objects of the invention will be apparent to those skilled in the art.

SUMMARY OF THE INVENTION

A lock is described which is adapted for use in combination with a conventional latching handle assembly mounted on the bottom panel of a roll-up door mounted on a truck or the like. The lock includes a laterally movable dead bolt which, when locked, is in the pivotal path of the latching handle assembly thereby preventing the latching handle assembly from being moved to its unlocked position. A counter is also associated with the lock which visually indicates the number of times that the lock has been actuated.

DESCRIPTION OF THE PREFERRED EMBODIMENT

Figure 1:
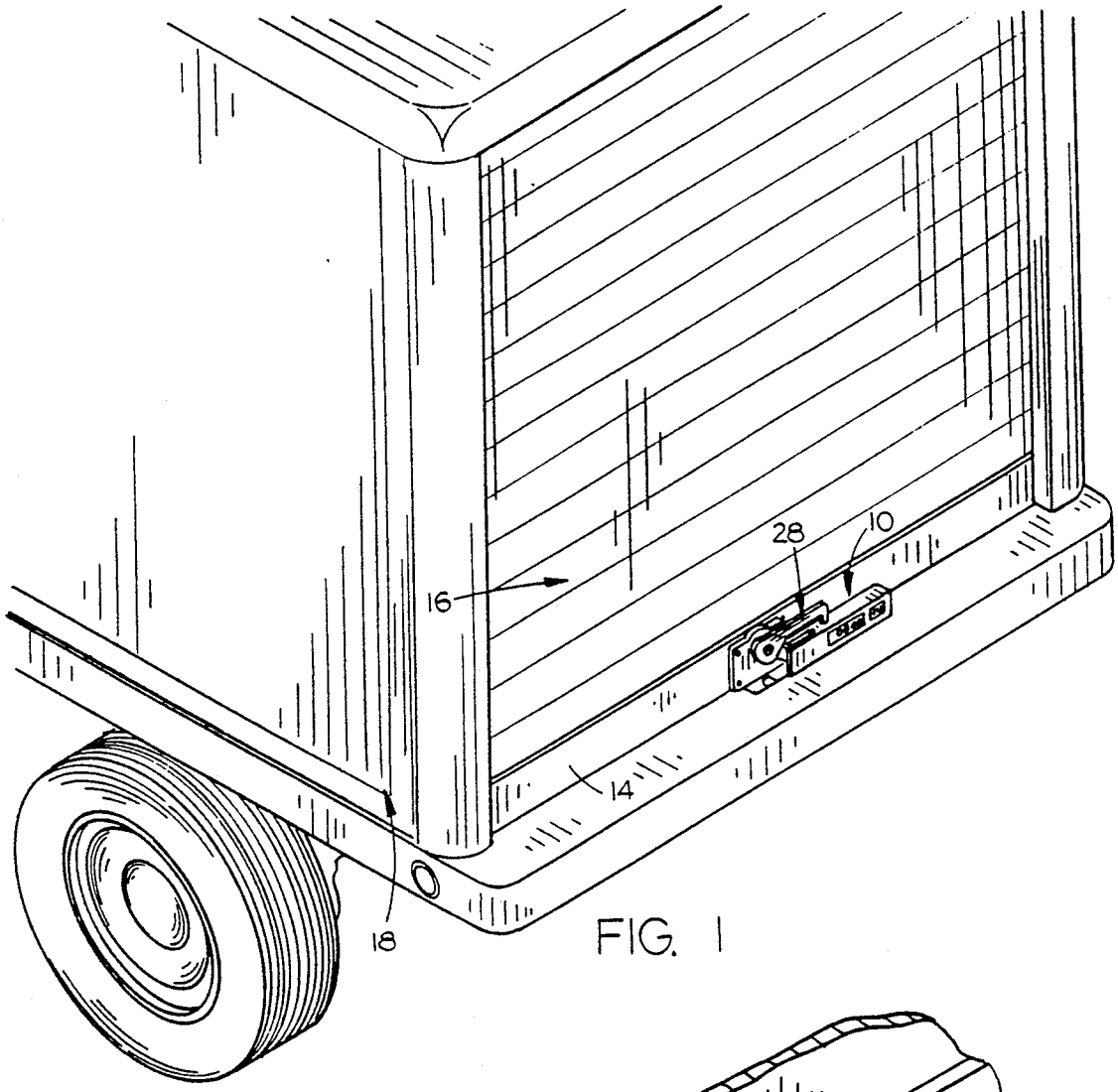
FIG. 1 is a partial rear perspective view of a conventional roll-up door mounted in the rear opening of a truck or van body.
Figure 2:
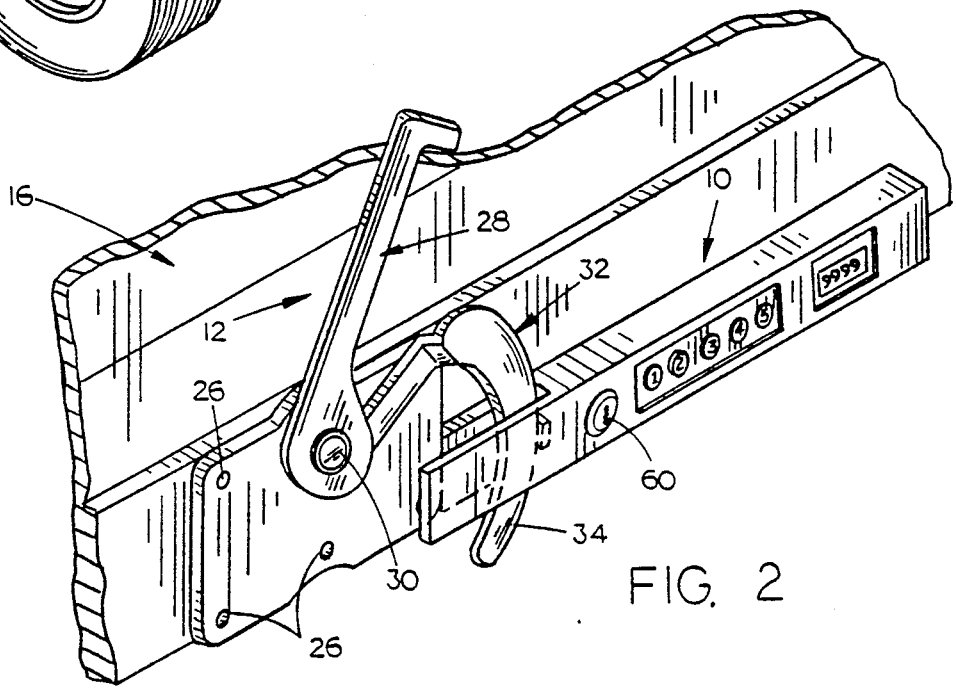
FIG. 2 is a rear perspective view of the lock of this invention.

The lock means of this invention is referred to generally by the reference numeral 10 and is designed to be utilized with a latching handle assembly indicated at 12 and which is sometimes referred to as a "J-hook" latching device.

Figure 3:
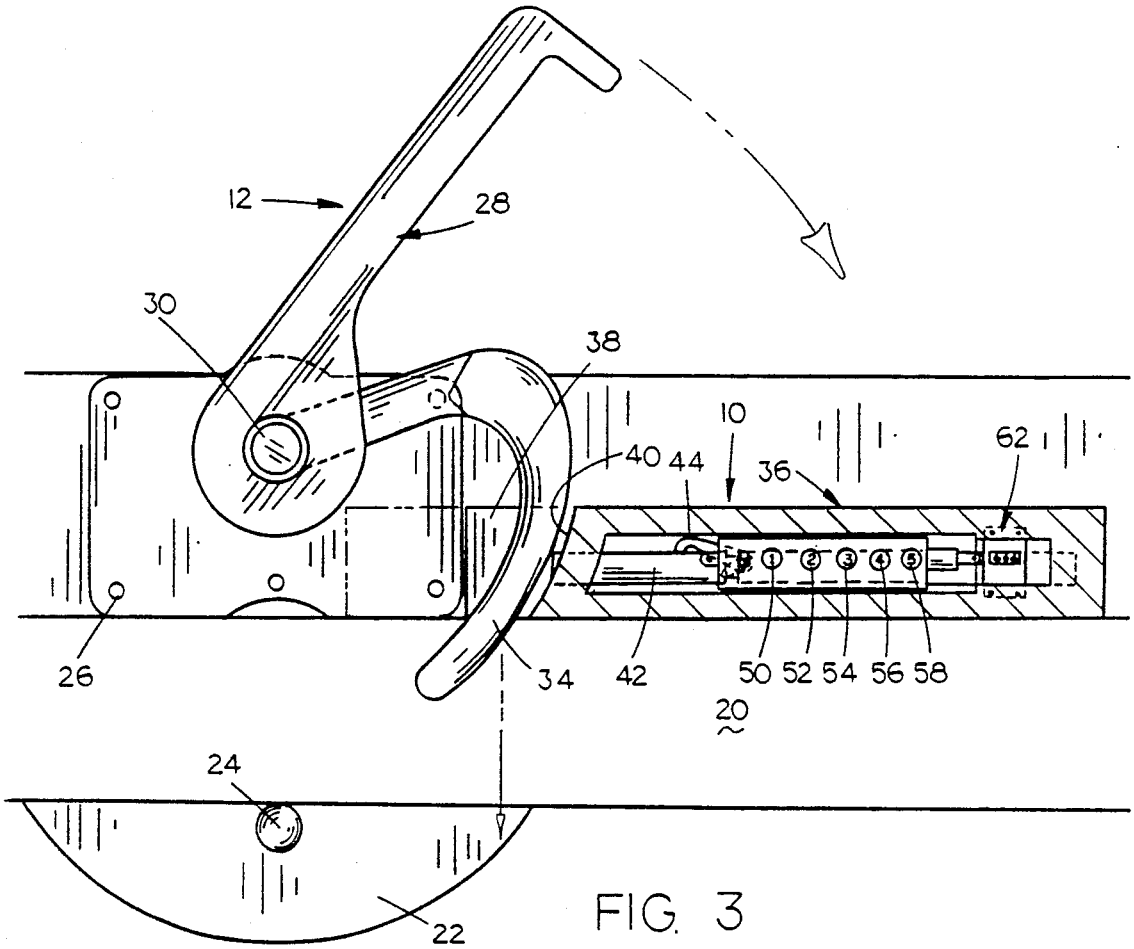
FIG. 3 is a rear elevational view of the lock of this invention illustrating the lock of this invention in its unlocked condition thereby permitting movement of the locking handle assembly.
Figure 4:
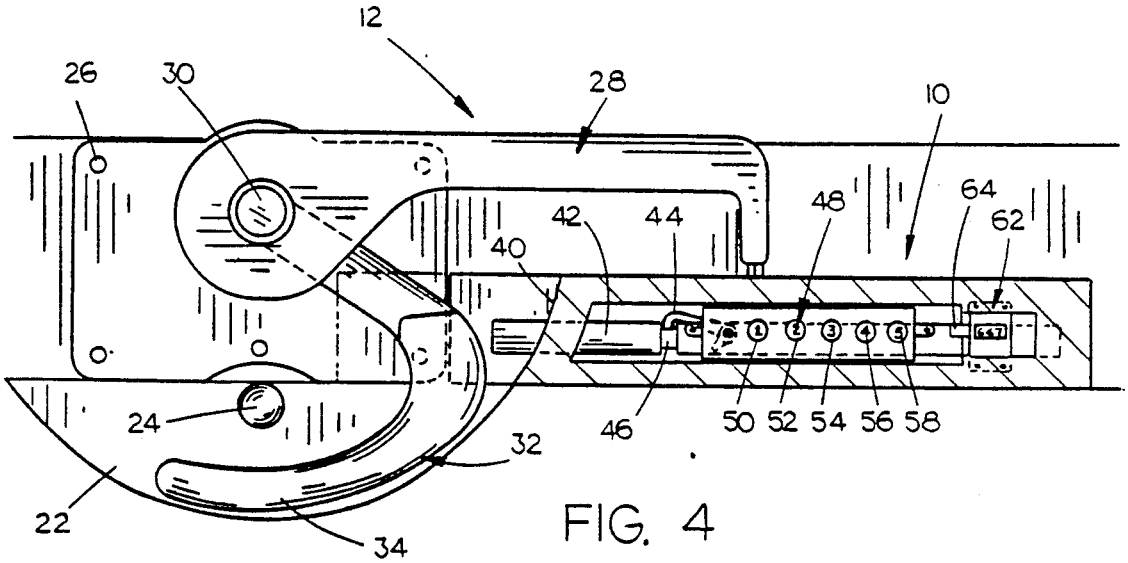
FIG. 4 is a view similar to FIG. 3 except that the lock of this invention is in its locked condition thereby preventing movement of the locking handle assembly.

Latching handle assembly 12 is mounted on the exterior surface of the bottom panel or section 14 of a conventional roll-up door 16 mounted on a van or truck body 18. Van body 18 includes a floor 20 having a recess 22 formed therein below latching handle assembly 12 as seen in the drawings. A longitudinally extending pin 24 is positioned in recess 22 as seen in FIGS. 3 and 4.

Latching handle assembly 12 is conventional in design and is secured to the bottom panel 14 by screws 26 extending thereinto from the interior surface of panel 14. Assembly 12 includes a handle 28 which is pivotally mounted on shaft 30 to enable the handle 28 to be moved between the "open" or unlatched position of FIG. 3 to the "closed" or latched position of FIG. 4. A hook member 32 is secured to shaft 30 for movement therewith and has an arcuate portion 34 which is adapted to be positioned below the pin means 24 to prevent the door 16 from moving upwardly.

Lock means 10 is mounted on the exterior surface of panel 16 laterally of assembly 12 and includes an elongated housing 36 which is secured to panel 16 by screws or the like extending through panel 16 into the forward portion thereof. Housing 36 is provided with a recessed portion 38 at one end thereof adapted to receive the hook 32 therein as seen in the drawings. The inner end of recessed portion 38 terminates in an arcuate shoulder 40. An elongated, spring loaded dead bolt 42 is movably mounted in housing 36 and is held in the locked position of FIG. 4 by a pawl 44 positioned in groove 46 formed in dead bolt 42.

The operation of dead bolt 42 is controlled by a conventional combination and key locking mechanism 48 such as that described in U.S. Pat. No. 3,040,556. The combination portion of locking mechanism 48 is controlled by a plurality of push-buttons, 50, 52, 54, 56 and 58. Locking mechanism 48 may also be controlled by a key which is insertable into barrel 60.

When dead bolt 42 is in the locked position of FIG. 4, the end of the dead bolt 42 is in the pivotal path of hook 32 thereby preventing the movement of handle 28. When the locking mechanism 48 is unlocked, either with a proper combination or with a key, dead bolt 42 is free to move to the right as viewed in FIG. 3 thereby permitting the door to be opened.

It is preferred that a conventional counter mechanism 62 also be utilized for recording and indicating the number of times the locking mechanism has been operated. Mechanism 62 includes a laterally extending plunger 64 which is connected to the counter and which is depressed by the end of the dead bolt when dead bolt 42 is moved to the right as viewed in FIG. 4.

Thus it can be seen that a novel lock has been provided for use with a conventional latching handle assembly mounted in a roll-up door. When locked, the locking device prevents the latching handle assembly from being moved to its open position. The locking device may be easily unlocked either by means of a key or by pressing the proper push button sequence. Further, the counter associated with the device of this invention enables a person to determine the number of times that the lock has been opened.

Thus it can be seen that the device accomplishes at least all of its stated objectives.

We claim:

1. In combination:

a van body having a floor and a vertically movable roll-up door adapted to be lowered into engagement with the floor to close an opening in the van body, said floor having a recess formed therein extending downwardly thereinto and a longitudinally extending pin means positioned within said recess;

a locking handle pivotally secured, about a horizontal axis, to said door adjacent the exterior lower edge thereof, said handle being pivotally movable between first and second positions;

said locking handle having an arcuate hook member associated therewith for pivotal movement with said handle, said hook member being positioned beneath said pin means when said handle is in its first position, to prevent the raising of said roll-up door, said hook member being pivoted out from under said pin means when said handle is in its second position, to allow the raising of said roll-up door; and a selectively actuated lock means secured to the exterior surface of said door laterally of said locking handle and including a horizontally movable dead bolt operable between locked and unlocked conditions, said dead bolt being immovably locked in the pivotal path of said arcuate hook member when in its locked condition to prevent the movement of said locking handle to its second position, and said dead bolt being horizontally movable by contact from said arcuate hook member when in its unlocked condition to allow movement of said locking handle to its second position.

2. The combination of claim 1, wherein said lock means is contained within a housing, said housing have a recess therein adapted to receive said hook member as it pivots in response to movement of said handle between said first and second positions.

3. The combination of claim 2, wherein said dead bolt is operably mounted for selectively lockable horizontal movement into said recess of said housing into the pivotal path of said hook member.

4. The combination of claim 1 wherein said lock means also comprises a counter means which records and indicates the number of times said lock means is opened.

5. The combination of claim 1 wherein said lock means is key actuated and combination actuated.

6. The combination of claim 5 wherein said lock means also comprises a counter means which records and indicates the number of times said lock means is opened.

* * * * *